US007271141B2

(12) United States Patent
Kaiser et al.

(10) Patent No.: US 7,271,141 B2
(45) Date of Patent: Sep. 18, 2007

(54) WATER SOLUBLE PACKAGES CONTAINING LIQUID COMPOSITIONS

(75) Inventors: Roger Kaiser, Limburgerhof (DE); Ralf Wiedemann, Griesheim (DE); Marcus Guzmann, Leimen (DE)

(73) Assignee: Reckitt Benckiser N.V. & Reckitt Benckiser (UK) Limited, Hoofddorp (NL)

( * ) Notice: Subject to any disclaimer, the term of this patent is extended or adjusted under 35 U.S.C. 154(b) by 0 days.

(21) Appl. No.: 10/364,000

(22) PCT Filed: Aug. 23, 2001

(86) PCT No.: PCT/GB01/03821

§ 371 (c)(1),
(2), (4) Date: Aug. 1, 2003

(87) PCT Pub. No.: WO02/16541

PCT Pub. Date: Feb. 28, 2002

(65) Prior Publication Data

US 2005/0026806 A1 Feb. 3, 2005
US 2005/0222005 A2 Oct. 6, 2005

(30) Foreign Application Priority Data

Aug. 25, 2000 (GB) ..... 0020965.0
Aug. 25, 2000 (GB) ..... 0021112.8
Aug. 25, 2000 (GB) ..... 0021113.6
Oct. 18, 2000 (GB) ..... 0025541.4
Oct. 18, 2000 (GB) ..... 0025542.2

(51) Int. Cl.
*C11D 17/04* (2006.01)
*C11D 3/06* (2006.01)

(52) U.S. Cl. ..... 510/296; 510/405; 510/406; 510/439

(58) Field of Classification Search ..... 510/296, 510/405, 406, 439
See application file for complete search history.

(56) References Cited

U.S. PATENT DOCUMENTS

| | | | | |
|---|---|---|---|---|
| 3,720,621 A | | 3/1973 | Smeets | 252/135 |
| 4,153,569 A | | 5/1979 | Van den Brom | 252/109 |
| 4,927,555 A | * | 5/1990 | Colarusso, Jr. | 510/221 |
| 4,973,416 A | | 11/1990 | Kennedy | 252/90 |
| 5,205,953 A | * | 4/1993 | Dixit | 510/223 |
| 5,213,706 A | * | 5/1993 | Rapisarda et al. | 510/221 |
| 5,372,740 A | * | 12/1994 | Fair et al. | 510/221 |
| 6,090,762 A | * | 7/2000 | Clapperton et al. | 510/108 |

FOREIGN PATENT DOCUMENTS

| | | |
|---|---|---|
| CA | 1112534 | 11/1981 |
| DE | 2029 598 | 12/1970 |
| EP | 0 170 091 | 2/1986 |
| EP | 0 441 057 A1 | 8/1991 |
| EP | 0 446 761 A1 | 9/1991 |
| EP | 0 623 670 A2 | 9/1994 |
| GB | 2 007 253 | 5/1979 |
| WO | 86 05510 | 9/1986 |
| WO | 92/17382 | 10/1992 |
| WO | 94/04656 | 3/1994 |
| WO | 01/02531 A1 | 1/2001 |

* cited by examiner

*Primary Examiner*—Lorna M. Douyon
(74) *Attorney, Agent, or Firm*—Norris McLaughlin & Marcus, PA

(57) ABSTRACT

An aqueous liquid composition having a water content of between 20 and 50 wt. %, comprising at least one polyphosphate builder material, potassium ions and sodium ions, wherein the molar ratio of potassium to sodium is between 0.55:1 and 20:1.

21 Claims, No Drawings

WATER SOLUBLE PACKAGES CONTAINING LIQUID COMPOSITIONS

The present invention relates to a detergent composition as well as to a process for preparing such a composition.

It is known to package detergents or related materials such as water-softeners in containers or sachets of water-soluble or water-dispersible film material, in particular to avoid direct contact of the hazardous or irritant material with the consumers' skin. Moreover, dosage is easier with packaged material, and it can simply be added to water to release the contents of the container or sachet into the water during usage.

Although a large number of aqueous liquid detergent compositions, mostly in gel form, for use in automatic dishwashers or for laundry, have been described in the prior art, such as in U.S. Pat. Nos. 4,973,416 and 5,213,706, WO 94/14941 or DE-OS 20 29 598, none of those compositions has been proposed for being packaged in water-soluble or water-dispersible film material.

CA-A-1,112,534 discloses a package made of water-soluble material in film form enclosing within it a paste-form, automatic dishwasher-compatible detergent composition. Detergent compositions described in this document are, for example, based on sodium tripolyphosphate.

However, for manufacturing portioned packages of the material, it is desired to obtain a highly concentrated liquid composition. It is known that potassium tripolyphosphate has a higher solubility than the respective sodium salt. Unfortunately, replacement of sodium tripolyphosphate by potassium tripolyphosphate results in a less stable product composition as to long-term weight variation by gain or loss of free water. In particular, for transparent products, such weight variation might be detrimental for the appearance as it may cause occurrence of turbidity or crystallization of the product. In addition the use of exclusively potassium salts of such builder salts such as potassium tripolyphosphate is more costly than the use of the corresponding sodium salts.

The present invention seeks to provide for a detergent product comprising an aqueous liquid detergent composition packaged in a water-soluble or water-dispersible packaging and having an improved stability as to long-term weight variation.

The present invention provides a package comprising an aqueous liquid detergent composition enclosed by a water-soluble or water-dispersible packaging material, said aqueous liquid detergent composition having a water content of between 20 and 50 wt. %, and comprising at least one polyphosphate builder material, potassium and sodium ions, wherein the molar ratio of potassium to sodium is between 0.55:1 and 20:1.

We have now surprisingly discovered that an aqueous liquid composition, preferably a detergent composition, with a water content of between 20 and 50 wt. %, containing at least one polyphosphate builder material, potassium ions and sodium ions, wherein the molar ratio of potassium to sodium is between 0.55:1 and 20:1, shows good stability when packaged in a water-soluble or water-dispersible packaging. The potassium ions may be provided by one or more sources of potassium ions, and the sodium ions may be provided by one or more sources of sodium ions. The source of potassium or sodium ions may also be the polyphosphate builder material.

Preferably, the water content of this composition is between 30 and 40 wt. %.

The molar ratio of potassium to sodium is preferably between 0.6:1 and 10:1, more preferably between 0.65:1 and 5:1, and most preferably between 0.9:1 and 1.6:1, i.e. near equimolar.

In a preferred embodiment of the invention, the polyphosphate builder material is at least partly in the form of tripolyphosphate, and is preferably at least partly potassium tripolyphosphate.

The preferred source of sodium ions is at least partly a co-builder material, preferably of the oligocarboxylate or polycarboxylate type, such as compounds selected from the group consisting of sodium citrate, sodium polyacrylate and its copolymers, sodium gluconate and mixtures thereof.

Furthermore, it is preferred that the composition in its uncoloured form is a translucent or transparent liquid or gel having a transmission ratio of more than 30%, preferably more than 40%, most preferably more than 50%, measured in accordance with the ELVORS transmission method.

In a preferred form the packaging is made from a water-soluble or water-dispersible material particularly in the form of a film or a moulding, selected from the group consisting of poly(vinylalcohol) based homopolymers, copolymers or graft polymers, polyethylene oxide and cellulose derivatives.

In a preferred embodiment the aqueous composition is a dishwashing, rinse-aid, water-softening or laundry washing composition, such as a detergent composition, the product being preferably suitable for use in a domestic dishwashing or laundry machine.

The present invention also provides a process for preparing an aqueous liquid composition having a water content of between 20 and 50 wt. %, comprising at least one polyphosphate builder material, and at least one source of potassium ions and at least one source of sodium ions, wherein the molar ratio of potassium to sodium is between 0.55:1 and 20:1 wherein, in a first step, at least a major part (eg. more than 50%) of the source of sodium ions is dissolved in water, and, in a second step, the polyphosphate builder material is dissolved in the resulting aqueous solution. Preferably essentially all of the source of sodium ions is dissolved in water in the first step.

Preferably for this process, the source of sodium ions is sodium citrate and the polyphosphate builder is potassium tripolyphosphate.

The packaging (containers or sachets) made of water-soluble or water-dispersible material can be manufactured and filled by any appropriate method, for example thermoforming the film material to form a pocket, filling the pocket with the inventive aqueous composition and sealing the pocket with the same or a different film material. Sealing can be done by heat sealing across the flange of the pocket. Other methods of sealing may be used, for example, infra-red, radio frequency, ultrasonic, laser, solvent, vibration or spin welding. An adhesive, such as water or an aqueous solution of the film material, may also be used. There are also other methods of manufacturing the containers such as injection moulding, as disclosed, for example, in WO 01/36290. More details on manufacturing processes for the containers can be seen from the prior art such as CA-A-1,112,534.

There is a variety of polyphosphate builder materials appropriate for use in detergent compositions in particular the sodium or potassium salts of polyphosphates such as tripolyphosphate, pyrophosphate or metaphosphate. For the present invention, potassium tripolyphosphate is a preferred compound.

An essential feature of the inventive composition is the ratio of the potassium ions to sodium ions. Without being bound to the theory, it is hypothesized that the presence of those two types of cations in a specific molar ratio results in a specific equilibrium controlling the stability of long-term weight variation by loss or gain of water of the composition.

Although it is preferred to use potassium tripolyphosphate as the builder material, thus serving at the same time as at least one source for potassium ions, it is also possible to use a sodium polyphosphate builder material together with a different potassium salt.

The preferred source of sodium ions is of the oligocarboxylate or polycarboxylate type, such as sodium citrate, sodium polyacrylate and its copolymers, sodium gluconate or mixtures thereof. There is an additional benefit of using those materials, as they simultaneously show a co-builder effect, thus supporting the detergency.

The compositions can also optionally comprise one or more additional ingredients. These include conventional detergent composition components, such as surfactants, bleaches, bleach enhancing agents, silver-corrosion inhibiting agents, enzymes, enzyme stabilizers, soil release agents, dye transfer inhibiting agents, brighteners, perfumes, colorants, and dyes.

In preparing the inventive aqueous composition, it was surprisingly discovered that a specific order of steps is advantageous when a transparent composition is desired, namely to dissolve all or at least a major part (eg more than 50%) of the source of sodium ions, such as sodium citrate, sodium gluconate, etc., in water before adding the polyphosphate builder material, such as potassium tripolyphosphate, to the resulting aqueous solution. Attempts to prepare a transparent product by dissolving first a substantial part of the polyphosphate builder and only afterwards the source of sodium ions, resulted in opaque, milky products. Preferably, the other ingredients should be added after having completely dissolved the main components.

Also surprisingly, it was discovered that the inventive aqueous composition was easier to thicken by commonly used thickeners such as polyacrylates or derivatives or thickeners based on polysaccharides, e.g. xanthan gum, than expected, as thickening of such a concentrated composition with a high electrolyte content was thought to be particularly difficult. Surprisingly, there was no such effect observed with the aqueous composition of the present invention.

Further details and advantages of the inventive aqueous compositions can be seen from the following examples.

EXAMPLES

Examples 1 to 3 and Comparative Examples 1 to 3

Different aqueous compositions have been prepared according to following Table 1 below. The compositions of comparative examples 1 and 2 only contain potassium tripolyphosphate without any additional source of sodium ions. The composition of comparative example 3 contains only sodium salts including sodium tripolyphosphate.

Compositions 1 to 5 according to the invention were prepared by first adding the thickener to water, and subsequently dissolving completely the sodium citrate therein prior to the addition of the potassium tripolyphosphate. Further ingredients, such as enzymes, were added thereafter. In all cases a transparent or slightly pearlescent aqueous composition was obtained. A change of the order of adding sodium citrate and potassium tripolyphosphate to the water resulted in strongly opaque, milky compositions with undissolved particles.

The compositions according to the invention in the uncoloured form show very good transparency to light when measured by the ELVORS transmission method.

ELVORS Transmission Test Method:

A light source (500 W, Düwi GmbH, Mod. 93024) was installed facing a lux meter (Elvors LM-1010) at a distance of 130 cm. The light was allowed to pass through a sample of the inventive composition with a thickness of 5 mm which covered an area of 25 $cm^2$. The sample was located in 4 cm distance to the photocell. The value measured by the apparatus was recorded and a so-called transmission ratio was calculated with the following Formulation:

$$\text{RATIO} = \frac{\text{MATERIAL VALUE WITH THE COMPOSITION}}{\text{MEASURED VALUE WITH PURE WATER}} \times 100\%$$

Examples 1-5 show transmission ratios of 40-90%.

Comparative example 3 shows a transmission ratio of 7%.

For the preparation of the containers, poly(vinylalcohol) based film materials have been used, namely Hi Selon C-200, obtainable from Nippon synthetic Chemical Industry Co., Osaka, Japan, MONOSOL M8543, obtainable from Chris Craft Inc., Gary, Ind., U.S.A., and SOKALAN ES 95014, obtainable from BASF AG, Ludwigshafen, Germany, the film thicknesses being 100 μm. The poly (vinylalcohol) film was thermoformed in a Multivac thermoforming machine operating at 115 to 120° C., into a pocket of 39 mm length, 29 mm width and 16 mm depth. The thus formed pocket was filled with 10 ml of the inventive aqueous composition. Then, a 75 μm thick film of the same material as the pocket itself as placed on top and tightly sealed thereto at 144-148° C. Thus produced containers were separated from each other by cutting the flanges.

TABLE 1

| | Exp.1 | Exp.2 | Exp.3 | Exp.4 | Exp.5 | Comparative Exp.1 | Comparative Exp.2 | Comparative Exp.3 |
|---|---|---|---|---|---|---|---|---|
| Potassium Tripolyphosphate | 30.00 | 30.00 | 30.00 | 33.50 | 25.0 | 54.7 | 50.0 | — |
| Sodium tripolyphosphate | — | — | — | — | — | — | — | 19.8 |
| Sodium citrate | 30.00 | 30.00 | 30.00 | 33.50 | 25.0 | — | — | — |
| Potassium citrate | — | — | — | — | 10.0 | — | — | — |
| Sodium disilicate | — | — | — | — | — | — | — | 32.0 |
| Enzymes | 0.97 | 0.97 | 2.30 | 0.97 | 0.71 | — | 3.40 | 1.2 |
| Polyacrylate | — | 0.80 | 0.60 | 0.05 | 0.08 | — | — | — |
| Tallow alcohol | — | — | — | — | — | — | — | 7.9 |

TABLE 1-continued

| | Exp.1 | Exp.2 | Exp.3 | Exp.4 | Exp.5 | Comparative Exp.1 | Comparative Exp.2 | Comparative Exp.3 |
|---|---|---|---|---|---|---|---|---|
| Nonionic surfactant (EO/PO) | — | — | — | — | — | — | 0.50 | — |
| Xanthan Gum | — | — | — | — | — | — | 0.50 | — |
| Sokalan CP 5 | | | | | 0.50 | — | — | — |
| KOH | — | — | — | — | — | — | 0.10 | — |
| Phosphoric acid | 0.10 | — | — | 0.10 | — | — | — | — |
| Sulphuric acid | — | 0.10 | 0.10 | — | 0.10 | — | — | — |
| Preservative | | | | | — | 0.10 | 0.10 | — |
| Colorant | — | 0.05 | 0.05 | — | 0.020 | 0.50 | — | — |
| Water | 38.680 | 38.080 | 36.950 | 31.880 | 37.87 | 43.7 | 42.0 | 39.1 |
| Total | 100 | 100 | 100 | 100 | 100 | 100 | 100 | 100 |

For testing the stability of the containers filled with the compositions of the examples and the comparative examples, the containers were attached with one edge pending from a card in a room with stabilized environment conditions, namely a temperature of 20° C. and a relatively humidity of 60 to 65%.

The weight loss or gain of the containers were measured over time.

With the compositions of the comparative examples 1 and 2 a substantial weight loss was observed until about day 30. Thereafter, there was a surprising weight gain again. This instability of weight variation is undesirable for a transparent detergent composition packed in containers or sachets.

With the composition of the comparative example 3 a substantial weight loss was observed within 14 days. The formulation starts to crystallize after 6 days.

For the inventive compositions, there is only a slight weight loss of up to 4% maximum during the first days. Thereafter, the composition is rather stable showing no significant weight variations. This kind of stability in long-term weight variation is highly desirable for the above-mentioned products.

The features disclosed in the foregoing description, and/or in the claims may, both separately and in any combination thereof, be material for realising the invention in diverse forms thereof.

Example 6

The following formulation was prepared by mixing together the indicated components in the weight proportions indicated to prepare a heavy duty laundry liquid.

| | |
|---|---|
| Neodol 2507 $C_{11-15}$ linear alcohol | 18% |
| Biosoft D-62 sodium alkylbenzene sulfonate | 5.5% |
| Sodium carbonate | 2% |
| Anhydrous sodium metasilicate | 5% |
| Tetrapotassium pyrophosphate | 20% |
| Sodium citrate | 7.5% |
| Calsopol ETDZ 691 polymer obtainable from Goodrich | 0.5% |
| Dehardened water | 41.5% |

The composition was filled into a container using the following procedure.

A Multivac thermoforming machine operating at 6 cycles/min and at ambient conditions of 25° C., and 35% RH (±5% RH) was used to thermoform an anhydrous PVOH film. The PVOH film was prepared by a blown process from granules provided by PVAXX ref C120 having a degree of hydrolysis of 88% and a thickness of 110 μm. When formed the PVOH has a negligible water content. The PVOH film was wrapped in a sealed until immediately prior to use. The PVOH film was thermoformed into a rectangular mould of 39 mm length, 29 mm width and 16 depth, with the bottom edges being rounded to a radius of 10 mm, at 115-118° C. The thus formed pocket was filled with 17 ml of the composition, and an identical film was placed on top and heat sealed at 144-148° C. The thus produced containers were separated from each other by cutting the flanges. Each container was rounded and had a full appearance. After a few hours they attained an even more attractive, rounded appearance.

Example 7

Example 6 was repeated except that the formulation contained 0.2% citric acid and 0.2% sodium bicarbonate and the amount of water was reduced to 41.1%.

The PVOH film used was charged to Monosol M8534 (having a normal water content), obtained from Chris Craft Inc. Gary, Ind., USA, having a degree of hydrolysis of 88% and a thickness of 100. The pocket was filled with 10 ml of the composition and a 7.5 μm thick Monosol M8534 PVOH film was placed on top and heat sealed at 144-148° C.

The invention claimed is:

1. A package comprising an aqueous liquid detergent composition enclosed by a water-soluble or water dispersible packaging material, said aqueous liquid detergent composition having a water content of between 30 and 50 wt. %, and comprising at least a polyphosphate builder material, a source of sodium ions, a source of potassium ions wherein the molar ratio of potassium to sodium is between 0.55:1 and 20:1.

2. A package according to claim 1 wherein the water content is between 30 and 40 wt. %.

3. A package according to claim 1 wherein the molar ratio of potassium to sodium is between 0.6:1 and 10:1.

4. A package according to claim 2 wherein the molar ratio of potassium to sodium is between 0.6:1 and 10:1.

5. A package according to claim 3 wherein the molar ratio of potassium to sodium is between 0.65:1 and 5:1.

6. A package according to claim 5 wherein the molar ratio of potassium to sodium is between 0.9:1 and 1.6:1.

7. A package according to claim 1 wherein the sodium ions are provided at least partly by a co-builder material.

8. A package according to claim 7 wherein the co-builder material is based on a oligocarboxylate or polycarboxylate.

9. A package according to claim 8 wherein the co-builder material is selected from the group consisting of sodium citrate, sodium polyacrylate and its copolymers, sodium gluconate and mixtures thereof.

10. A package according to claim 1 wherein the composition in its uncoloured form is a translucent or transparent liquid or gel showing a transmission ratio of more than 30% measured in accordance with the ELVORS transmission method.

11. A package according to claim 1 wherein the composition in its uncoloured form is a translucent or transparent liquid or gel showing a transmission ratio of more than 40% measured in accordance with the ELVORS transmission method.

12. A package according to claim 1 wherein the composition in its uncoloured form is a translucent or transparent liquid or gel showing a transmission ratio of more than 50%, measured in accordance with the ELVORS transmission method.

13. A package according to claim 1 wherein the packaging material is a water soluble or water-dispersible film material.

14. A package according to claim 13 wherein the film material is selected from the group consisting of polyvinylalcohol based homopolymers or copolymers, or graft polymers, polyethylene oxide and cellulose derivatives.

15. A package according to claim 1 wherein the packaging material is an injected moulded polyvinylalcohol or a cellulose.

16. A package according to claim 1 wherein the aqueous composition is a dishwashing, rinse-aid, water-softening or laundry washing composition.

17. A package according to claim 16 which is suitable for use in a domestic dishwashing or laundry machine.

18. A process for preparing an aqueous liquid composition with a water content of between 30 and 50 wt. %, comprising at least one polyphosphate builder material, at least one source of potassium ions and at least one source of sodium ions, wherein the molar ratio of potassium to sodium is between 0.55:1 and 20:1 wherein, in a first step, dissolving at least a major part of the source of sodium ions in water, and, in a second step, dissolving the polyphosphate builder material in the resulting aqueous solution and subsequently, enclosing the aqueous liquid composition in a water-soluble or water-dispersible packaging material.

19. A process according to claim 18 wherein essentially all of the source of sodium ions is dissolved in water in the first step.

20. A process according to claim 18 wherein the source of sodium ions is sodium citrate and the polyphosphate builder is potassium tripolyphosphate.

21. A process according to claim 19 wherein the source of sodium ions is sodium citrate and the polyphosphate builder is potassium tripolyphosphate.

* * * * *